US008408939B2

(12) United States Patent
Davis et al.

(10) Patent No.: US 8,408,939 B2
(45) **Date of Patent: *Apr. 2, 2013**

(54) ELECTRICAL CONNECTOR SYSTEM

(75) Inventors: Wayne Samuel Davis, Harrisburg, PA (US); Robert Neil Whiteman, Jr., Middletown, PA (US)

(73) Assignee: Tyco Electronics Corporations, Berwyn, PA (US)

( * ) Notice: Subject to any disclaimer, the term of this patent is extended or adjusted under 35 U.S.C. 154(b) by 215 days.

This patent is subject to a terminal disclaimer.

(21) Appl. No.: 12/950,210

(22) Filed: Nov. 19, 2010

(65) Prior Publication Data

US 2012/0129394 A1 May 24, 2012

(51) Int. Cl.
*H01R 13/648* (2006.01)

(52) U.S. Cl. ..... 439/607.01

(58) Field of Classification Search ..... 439/607.01, 439/607.08, 638, 607.1, 108, 68, 65, 660
See application file for complete search history.

(56) References Cited

U.S. PATENT DOCUMENTS

| | | | | |
|---|---|---|---|---|
| 7,988,456 | B2 * | 8/2011 | Davis et al. | 439/65 |
| 8,167,651 | B2 * | 5/2012 | Glover et al. | 439/607.08 |
| 2012/0129395 | A1 * | 5/2012 | Davis et al. | 439/607.01 |

* cited by examiner

*Primary Examiner* — Edwin A. Leon

(57) ABSTRACT

An electrical connector system for mounting to a substrate is disclosed. The electrical connector system may include a plurality of wafer assemblies defining a mating end and a mating end. Each wafer assembly may include a first overmolded array of electrical contacts, each electrical contact defining an electrical mating connector extending past an edge of the overmold of the first overmolded array of electrical contacts at the mating end of the wafer assembly; a first ground shield configured to be assembled with the first overmolded array of electrical contacts; and a second overmolded array of electrical contacts configured to be assembled with the first overmolded array of electrical contacts, each electrical contact defining an electrical mating connector extending past an edge of the overmold of the second overmolded array of electrical contacts at the mating end of the wafer assembly.

20 Claims, 11 Drawing Sheets

ELECTRICAL CONNECTOR SYSTEM

RELATED APPLICATIONS

The present application is related to U.S. patent application Ser. No. 12/950,232, titled "Electrical Connector System," filed Nov. 19, 2010, the entirety of which is hereby incorporated by reference.

BACKGROUND

As shown in FIG. 1, backplane connector systems 1 are typically used to connect a first substrate 2, such as a printed circuit board, in parallel or in a perpendicular relationship with a second substrate 3, such as another printed circuit board. As the size of electronic components is reduced and electronic components generally become more complex, it is often desirable to fit more components in less space on a circuit board or other substrate. Consequently, it has become desirable to reduce the spacing between electrical terminals within backplane connector systems and to increase the number of electrical terminals housed within backplane connector systems. Accordingly, it is desirable to develop backplane connector systems capable of operating at increased speeds, while also increasing the number of electrical terminals housed within the backplane connector system.

SUMMARY

The high-speed backplane connector systems described below address these desires by providing electrical connector systems that are capable of operating at speeds of up to at least 12 Gbps.

In one aspect, an electrical connector system is disclosed. The system may include a wafer housing and a plurality of wafer assemblies defining a mating end and a mounting end. Each of the wafer assemblies may include a first overmolded array of electrical contacts, a first ground shield configured to be assembled with the first overmolded array of electrical contacts, and a second overmolded array of electrical contacts configured to be assembled with the first overmolded array of electrical contacts.

Each electrical contact of the first overmolded array of electrical contacts may define an electrical mating connector extending past an edge of an overmold of the first overmolded array of electrical contacts at the mating end of the wafer assembly. Similarly, each electrical contact of the second overmolded array of electrical contacts may define an electrical mating connector extending past an edge of an overmold of the second overmolded array of electrical contacts at the mating end of the wafer assembly.

In another aspect, a wafer assembly is disclosed. The wafer assembly may include a first overmolded array of electrical contacts, a first ground shield configured to be assembled with the first overmolded array of electrical contacts, a second overmolded array of electrical contacts configured to be assembled with the first overmolded array of electrical contacts, and a second ground shield configured to be assembled with the second overmolded array of electrical contacts.

Each electrical contact of the first overmolded array of electrical contacts may define an electrical mating connector extending past an edge of an overmold of the first overmolded array of electrical contacts at the mating end of the wafer assembly. Similarly, each electrical contact of the second overmolded array of electrical contacts may define an electrical mating connector extending past an edge of an overmold of the second overmolded array of electrical contacts at the mating end of the wafer assembly.

In yet another aspect, another wafer assembly is disclosed. The wafer assembly may include a first overmolded array of electrical contacts and a second overmolded array of electrical contacts configured to be assembled with the first overmolded array of electrical contacts. Each electrical contact of the first overmolded array of electrical contacts may define an electrical mating connector extending past an edge of an overmold of the first overmolded array of electrical contacts at a mating end of the wafer assembly. Similarly, each electrical contact of the second overmolded array of electrical contacts may define an electrical mating connector extending past an edge of an overmold of the second overmolded array of electrical contacts at the mating end of the wafer assembly. Each electrical contact of the first overmolded array of electrical contacts may be positioned in the wafer assembly adjacent to an electrical contact of the second overmolded array of electrical contacts to form a plurality of electrical contact pairs.

DETAILED DESCRIPTION

Figure 1:
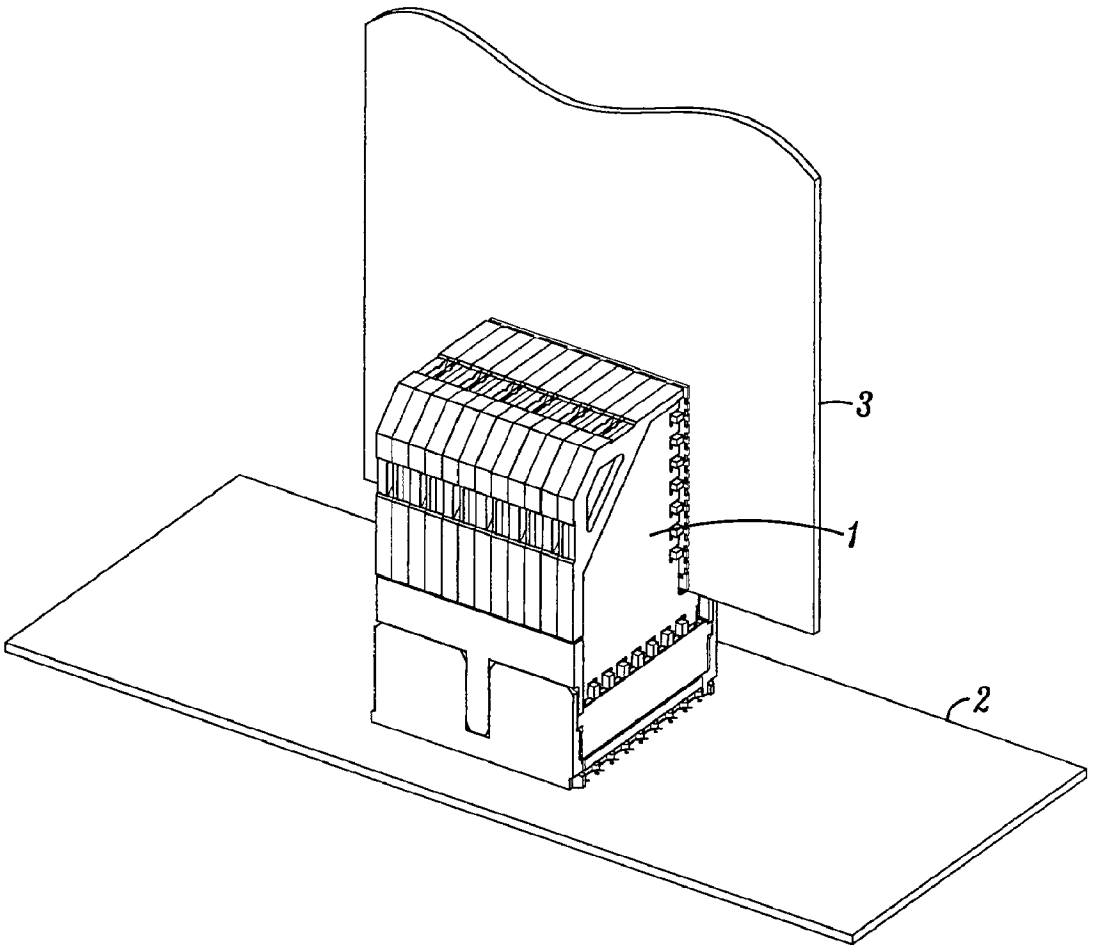
FIG. 1 (Prior Art)
FIG. 1 is a diagram of a backplane connector system connecting a first substrate to a second substrate.

The present disclosure is directed to high-speed backplane connectors systems that are capable of operating at speeds of up to at least 12 Gbps, while in some implementations also providing pin densities of at least 50 pairs of electrical connectors per inch. As will be explained in more detail below, implementations of the disclosed high-speed connector systems may provide ground shields and/or ground structures that substantially encapsulate electrical connector pairs, which may be differential electrical connector pairs, in a three-dimensional manner throughout a backplane footprint, a backplane connector, and a daughtercard footprint. These encapsulating ground shields and/or ground structures prevent undesirable propagation of non-traverse, longitudinal, and higher-order modes, and minimize cross-talk, when the high-speed backplane connector systems operate at frequencies up to at least 12 Gbps. Further, as explained in more detail below, implementations of the disclosed high-speed connector systems may provide substantially identical geometry between each connector of an electrical connector pair to prevent longitudinal moding.

A high-speed backplane connector system 100 is described with respect to FIGS. 2-11. The high-speed backplane connector 100 includes a plurality of wafer assemblies 102 that, as explained in more detail below, are positioned adjacent to one another within the connector system 100 by a wafer housing 104. The plurality of wafer assemblies 102 serves to provide an array of electrical paths between multiple substrates. The electrical paths may be, for example, signal paths or ground potential paths.

Each wafer assembly 106 of the plurality of wafer assemblies 102 may include a first overmolded array of electrical contacts 108 (also known as a first lead frame assembly), a second overmolded array of electrical contacts 110 (also known as a second lead frame assembly), a first ground shield 112, and a second ground shield 114. The first overmolded array of electrical contacts 108 includes a plurality of electrical contacts 116 partially surrounded by an insulating overmold 118, such as an overmolded plastic dielectric. The electrical contacts 116 may comprise, for example, any copper (Cu) alloy material.

Figure 8:
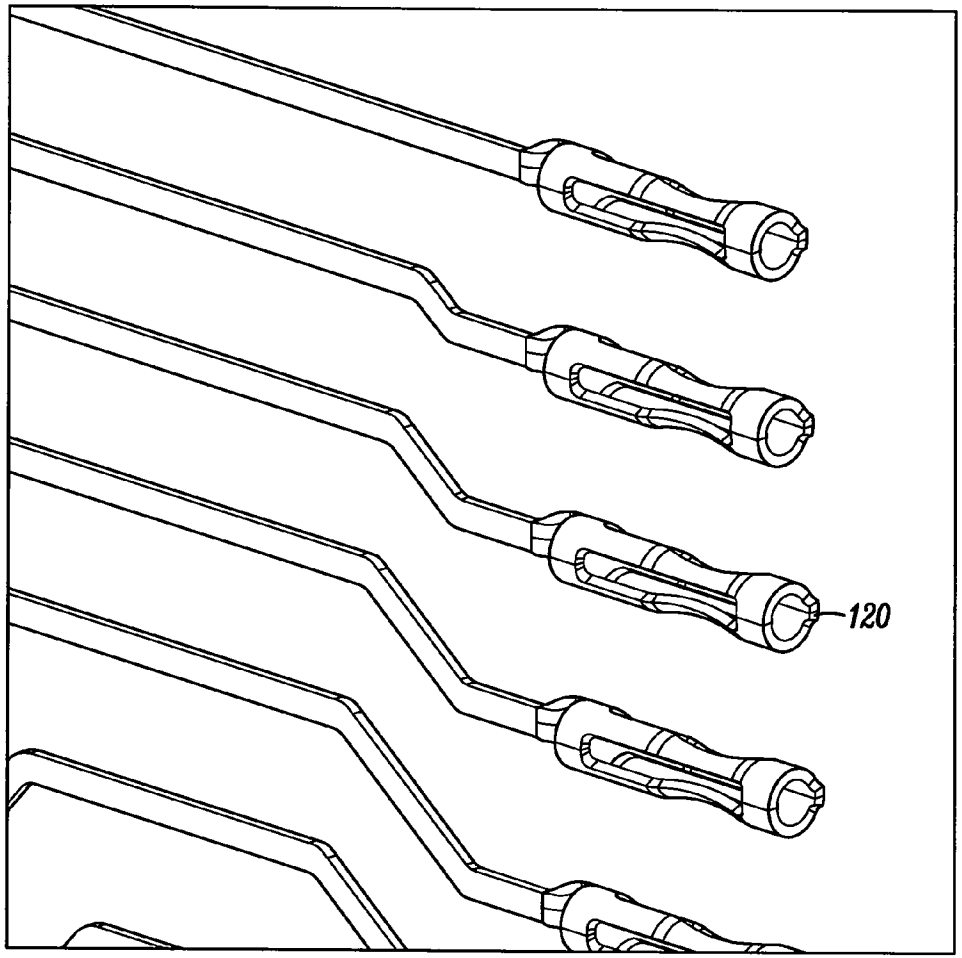
FIG. 8 illustrates a closed-band electrical mating connector.
Figure 9:
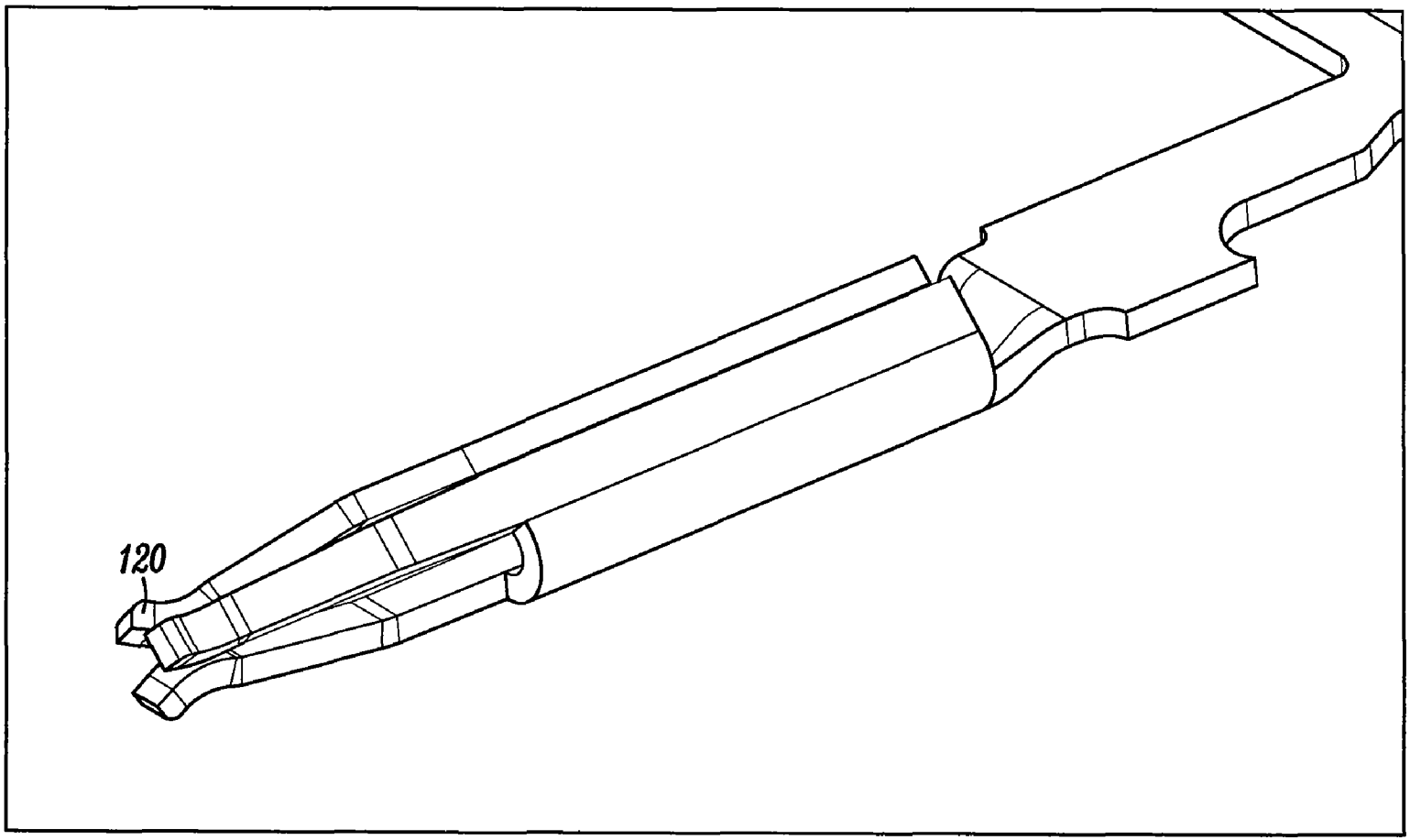
FIG. 9 illustrates a tri-beam electrical mating connector.
Figure 10:
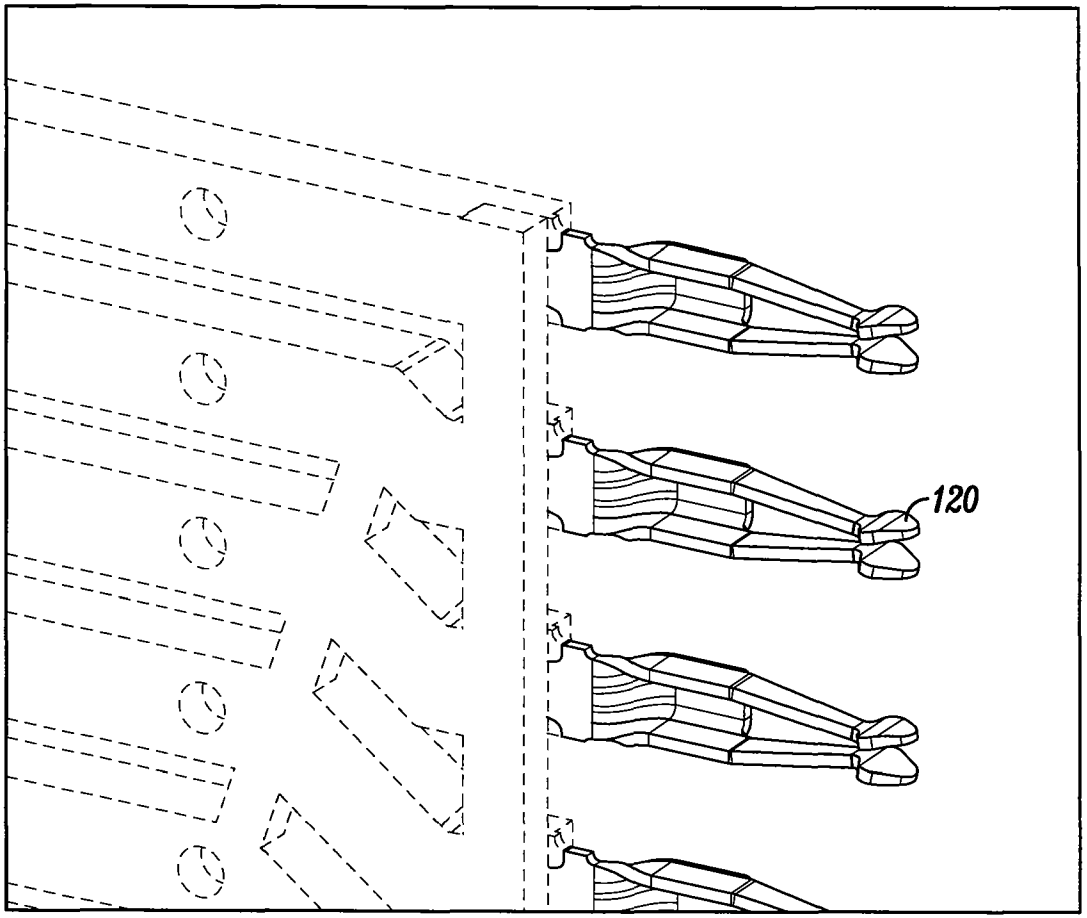
FIG. 10 illustrates a dual-beam electrical mating connector.
Figure 11:
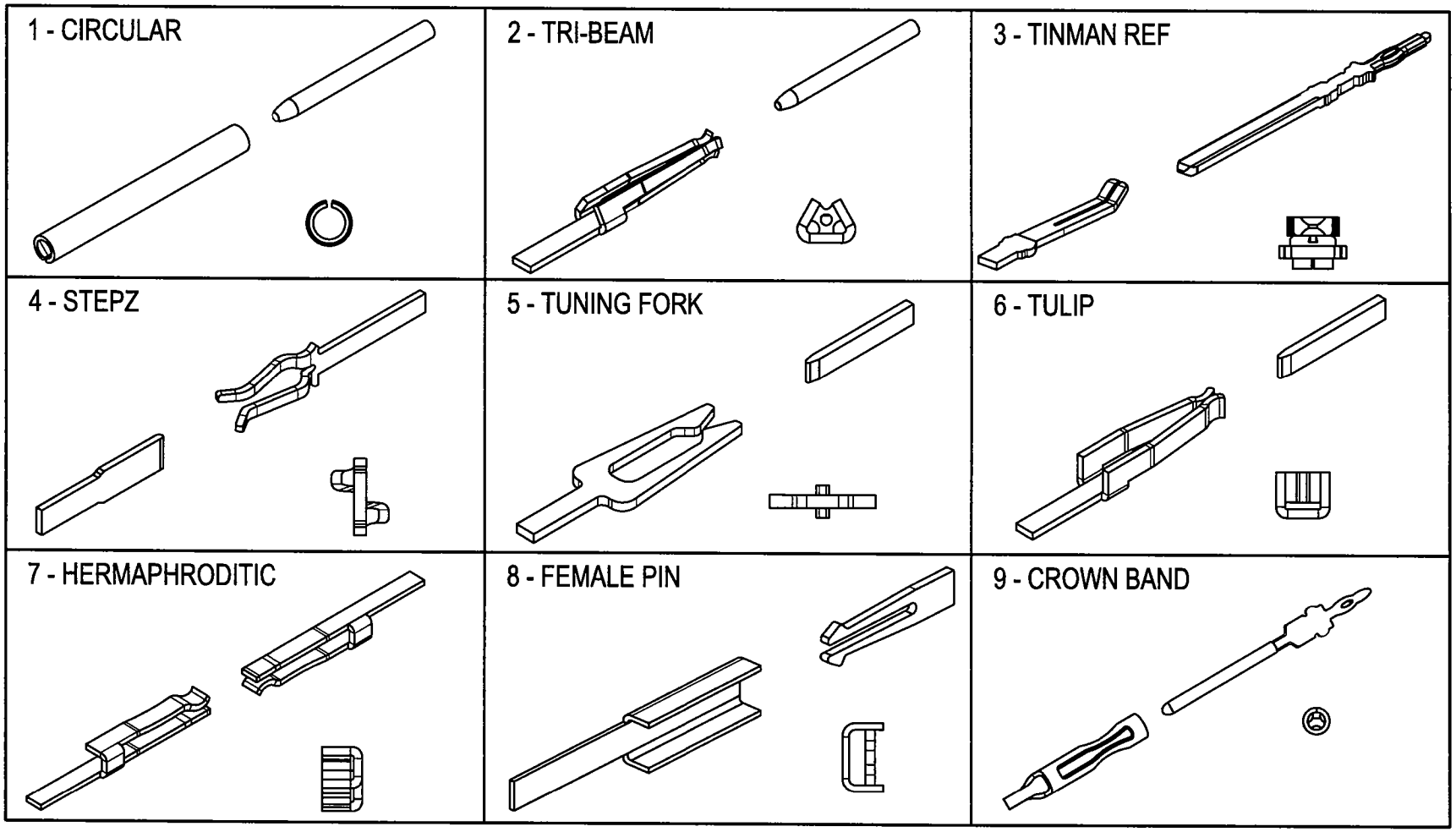
FIG. 11 illustrates additional implementations of electrical mating connectors.

The electrical contacts 116 define electrical mating connectors 120 that extend away from the insulating overmold 118 at a mating end 122 of the wafer assembly 106 and the electrical contacts 116 define substrate engagement elements 124, such as electrical contact mounting pins, that extend away from the insulating overmold 118 at a mounting end 126 of the wafer assembly 106. In some implementations, the electrical mating connectors 120 are closed-band shaped as shown in FIG. 8, where in other implementations, the electrical mating connectors 120 are tri-beam shaped as shown in FIG. 9 or dual-beam shaped as shown in FIG. 10. Other mating connector styles could have a multiplicity of beams. Examples of yet other implementations of electrical mating connectors 120 are shown in FIG. 11.

It will be appreciated that the tri-beam shaped, dual-beam shaped, or closed-band shaped electrical mating connectors 120 provide improved reliability in a dusty environment and provide improved performance in a non-stable environment, such as an environment with vibration or physical shock.

Referring to FIGS. 2-7, like the first overmolded array of electrical contacts 108, the second overmolded array of electrical contacts 110 includes a plurality of electrical contacts 128 partially surrounded by an insulating overmold 130. The electrical contacts 128 define electrical mating connectors 132 that extend away from the insulating overmold 130 at the mating end 122 of the wafer assembly 106 and the electrical contacts 128 define substrate engagement elements 133, such as electrical contact mounting pins, that extend away from the insulating overmold 130 at the mounting end 126 of the wafer assembly 106.

Figure 5:
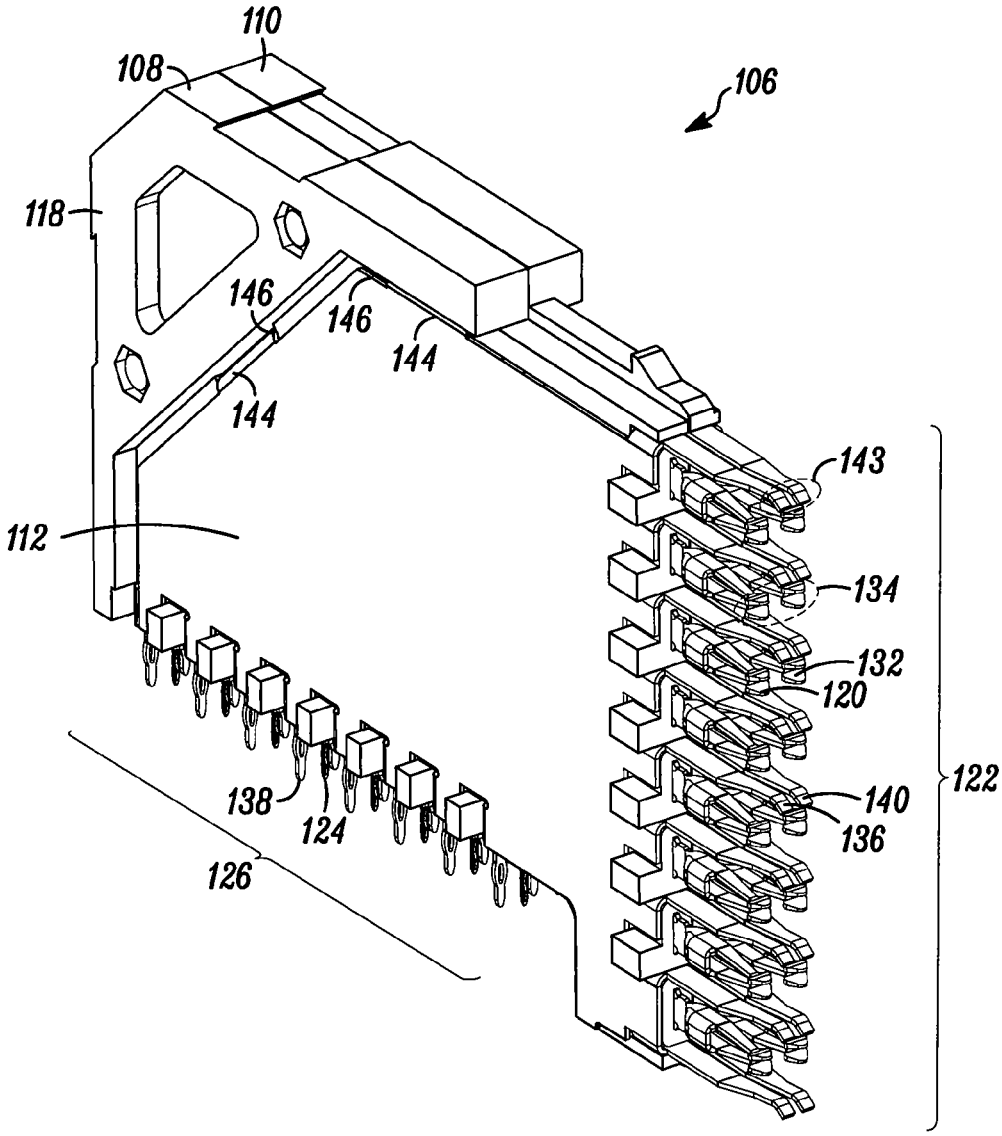
FIG. 5 is a perspective view of a wafer assembly.
Figure 6:
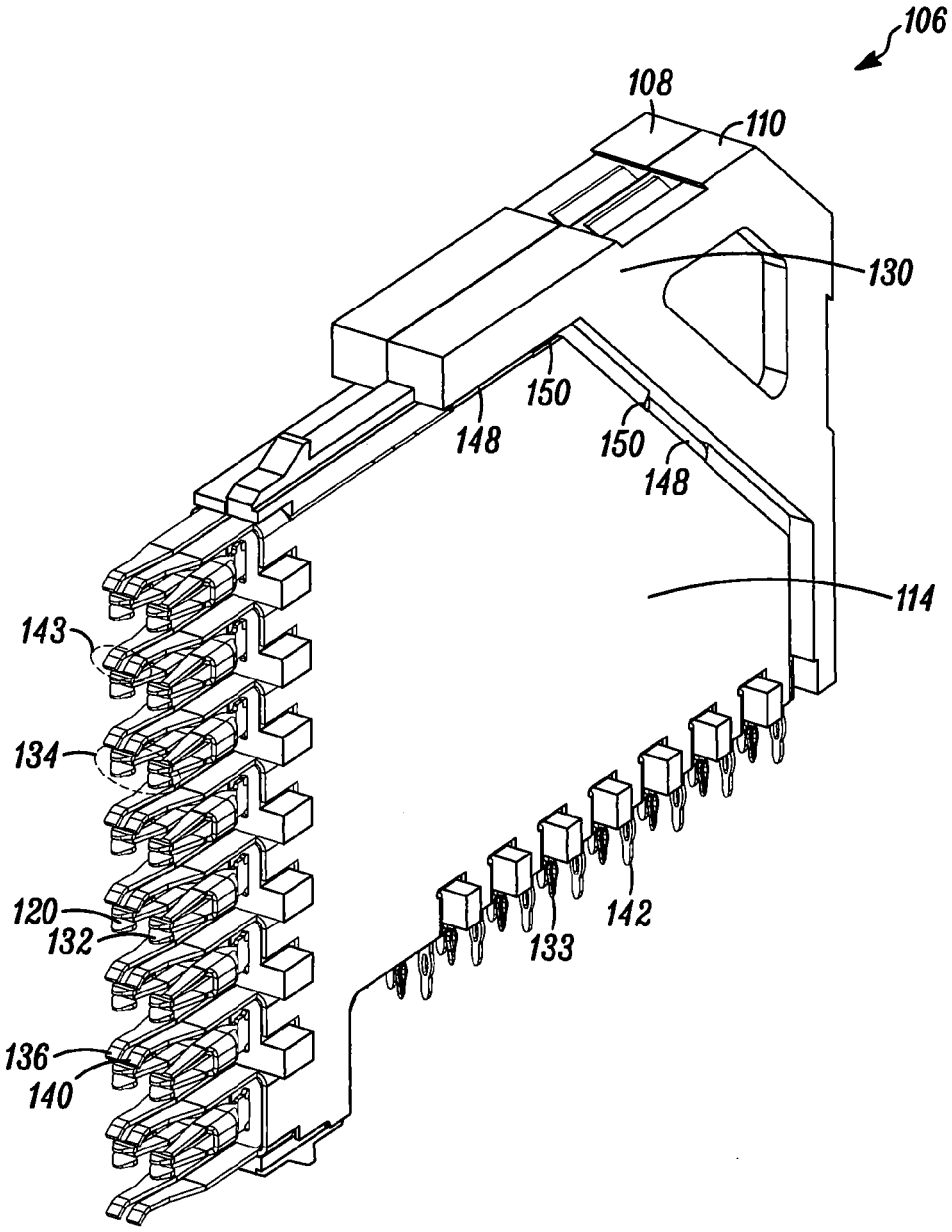
FIG. 6 is an additional perspective view of a wafer assembly.

The first overmolded array of electrical contacts 108 and the second overmolded array of electrical contacts 110 are configured to be assembled together as shown in FIGS. 5 and 6. In some implementations, when assembled together, each electrical contact 116 of the first overmolded array of electrical contacts 108 is positioned adjacent to an electrical contact 128 of the second overmolded array of electrical contacts 110 to form a plurality of electrical contact pairs 134, which may be differential pairs. In implementations where each electrical contact 116 of the first overmolded array of electrical contacts 108 is positioned adjacent to an electrical contact 128 of the second overmolded array of electrical contacts 110, a distance between an electrical contact of the first overmolded array of electrical contacts 108 and an adjacent electrical contact of the second overmolded array of electrical contacts 110 may remain substantially the same throughout the wafer assembly 106.

In some implementations, each electrical mating connector 120 of the first overmolded array of electrical contacts 108 mirrors an adjacent electrical mating connector 132 of the second overmolded array of electrical contacts 110. It will be appreciated that mirroring the electrical contacts of the electrical contact pair 134 provides advantages in manufacturing as well as column-to-column consistency for high-speed electrical performance, while still providing a unique structure in pairs of two columns.

The first ground shield 112 is configured to be assembled with the first overmolded array of electrical contacts 108 such that the first ground shield 112 is positioned at a side of the first overmolded array of electrical contacts 108 as shown in FIG. 5. In some implementations, the first ground shield 112 may comprise a base material such as phosphor bronze with tin (Sn) over nickel (Ni) at the mounting end 126 of the ground shield and gold (Au) over nickel (Ni) at the mating end 122 of the ground shield.

The first ground shield may define a plurality of ground tab portions 136 at the mating end 122 of the wafer assembly and the first ground shield may define a plurality of substrate engagement elements 138, such as ground mounting pins, at the mounting end 126 of the wafer assembly 106. In some implementations, when the first ground shield 112 is assembled with the first overmolded array of electrical contacts 108, a ground tab portion of the plurality of ground tab portions 136 of the first ground shield 112 is positioned above and/or below each electrical mating connector 120 of the first overmolded array of electrical contacts 108.

The second ground shield 114 is configured to be assembled with the second overmolded array of electrical contacts 110 such that the second ground shield 114 is positioned at a side of the second overmolded array of electrical contacts 110 as shown in FIG. 6. In some implementations, the second ground shield 114 may comprise a base material such as phosphor bronze with tin (Sn) over nickel (Ni) at the mounting end 126 of the ground shield and gold (Au) over nickel (Ni) at the mating end 122 of the ground shield. Similar to the first ground shield 112, the second ground shield 114 may define a plurality of ground tab portions 140 at the mating end 122 of the wafer assembly and the second ground shield 114 may define a plurality of substrate engagement elements 142, such as ground mounting pins, at the mounting end 126 of the wafer assembly 106.

In some implementations, when the second ground shield 114 is assembled to the second overmolded array of electrical contacts 110, a ground tab portion of the plurality of ground tab portions 140 of the second ground shield 114 is positioned above and/or below each electrical mating connector 132 of the second overmolded array of electrical contacts 110.

When the wafer assembly 106 is assembled, each ground tab portion of the plurality of ground tab portions 136 of the first ground shield 112 may be positioned adjacent to a ground tab portion of the plurality of ground tab portions 140 of the second ground shield 114 to form a plurality of ground tabs 143. The positioning of the plurality of ground tab portions 136 of the first ground shield 112 adjacent to the plurality of ground tab portions 140 of the second ground shield 114 may assist in providing the wafer assembly 106 with a common ground.

In some implementations, a ground tab portion 136 of the first ground shield 112 engages and/or abuts an adjacent ground tab portion 140 of the second ground shield 114. However, in other implementations, a ground tab portion 136 of the first ground shield 112 does not engage or abut an adjacent ground tab portion 140 of the second ground shield 114.

Figure 4:
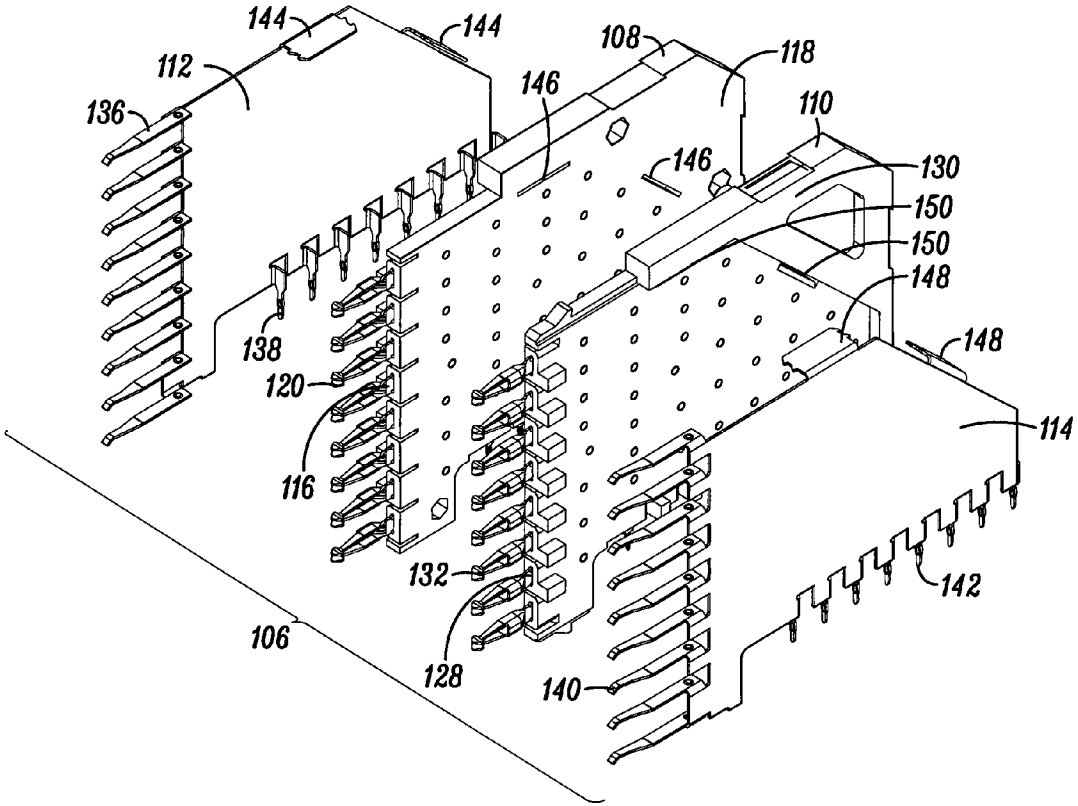
FIG. 4 is an exploded view of a wafer assembly.

Referring to FIG. 4, the first ground shield 112 may define one or more engagement elements 144 that engage the first overmolded array of electrical contacts 108 when the first ground shield 112 is assembled to the first overmolded array of electrical contacts 108. In some implementations, one or more of the engagement elements 144 may be a barbed tab that is positioned within an aperture 146 of the first overmolded array of electrical contacts 108 configured to receive the barbed tab. The second ground shield 114 may also define one or more engagement elements 148 that engage the second overmolded array of electrical contacts 110 when the second ground shield 114 is assembled to the second overmolded array of electrical contacts 110. In some implementations, one or more of the engagement elements 148 may be a barbed tab that is positioned within an aperture 150 of the second overmolded array of electrical contacts 110 configured to receive the barbed tab.

When the wafer assembly 106 is assembled, an engagement element 144 of the first ground shield 112 may be positioned adjacent to an engagement element 148 of the second ground shield 114. The positioning of the engagement element 144 of the first ground shield 112 adjacent to the engagement element 148 of the second ground shield 114 may assist in providing the wafer assembly 106 with a common ground.

In some implementations, an engagement element 144 of the first ground shield 112 may abut and/or engage an adjacent engagement element 148 of the second ground shield 114. However, in other implementations, an engagement element 144 of the first ground shield 112 does not abut or engage an adjacent engagement element 148 of the second ground shield 114.

Figure 2:
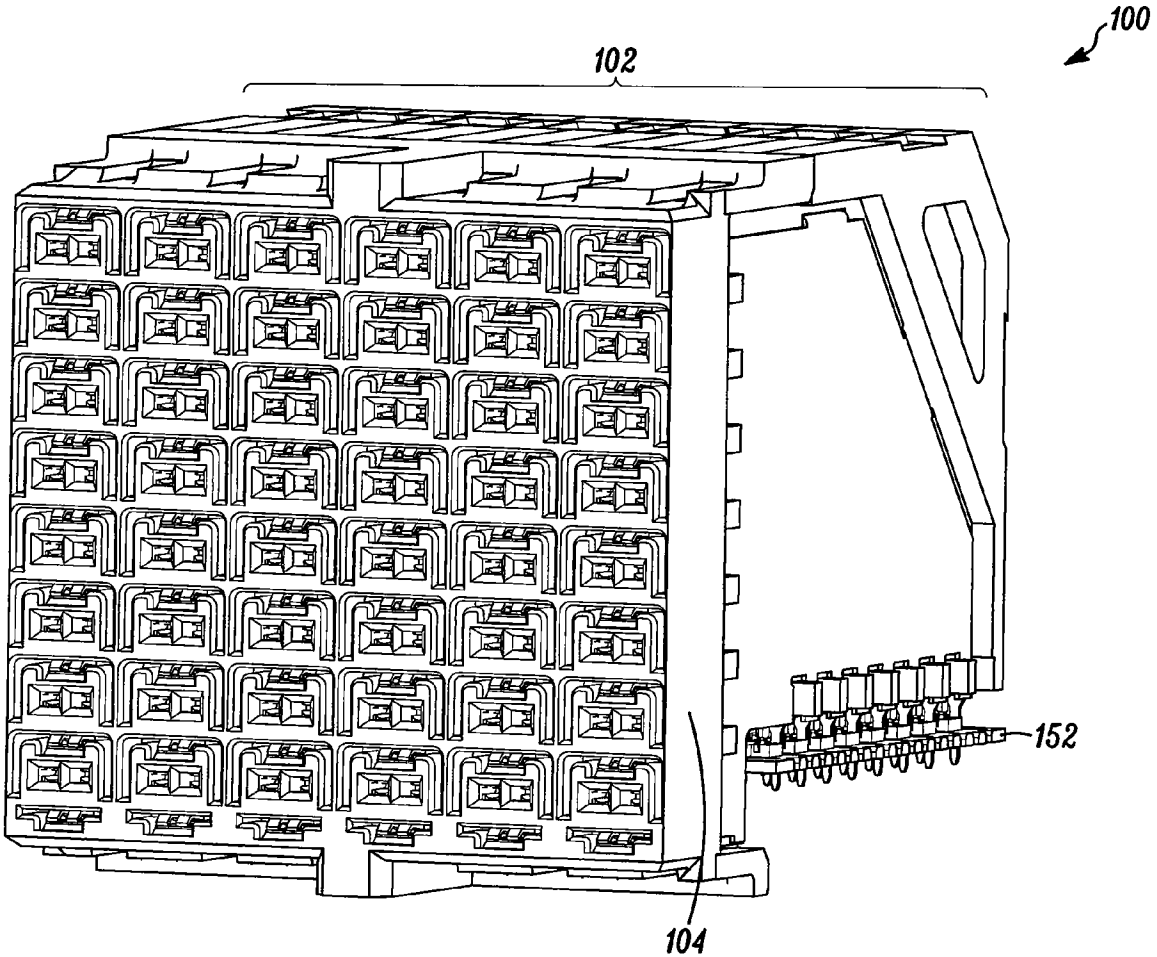
FIG. 2 is a perspective view of a portion of a high-speed backplane connector system.
Figure 3:
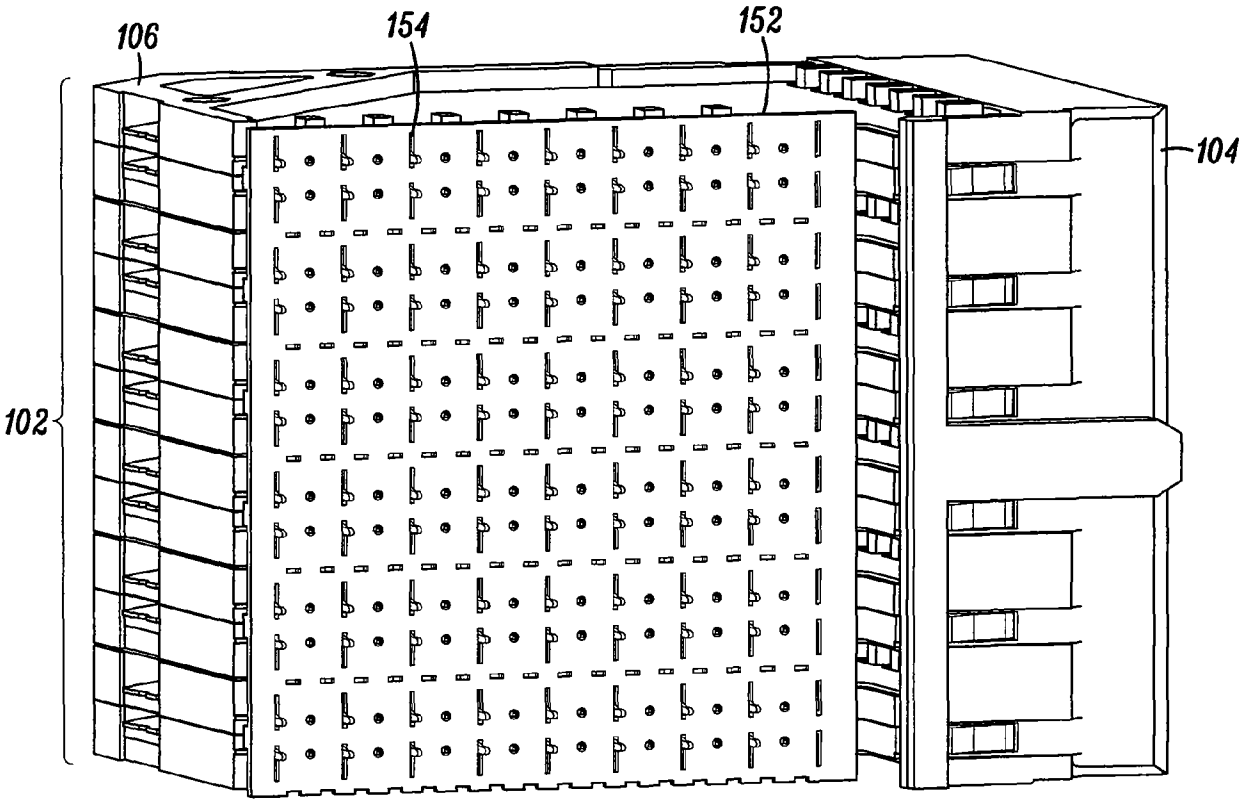
FIG. 3 is a bottom view of a portion of a high-speed backplane connector system.

As shown in FIGS. 2 and 3, the wafer housing 104 positions the wafer assemblies 106 of the plurality of wafer assemblies 102 adjacent to one another when the high-speed backplane connector system 100 is assembled. The wafer housing 104 engages the plurality of wafer assemblies 102 at the mating end 122 of each wafer assembly 106 by accepting the electrical mating connectors 120, 132 and ground tabs 143 extending from each wafer assembly 106. In some implementations, the first overmolded array of electrical contacts 108 and/or the second overmolded array of electrical contacts 110 of the wafer assembly 106 may define one or more stops 151 that abut the wafer housing 104 when the wafer assembly 106 is positioned in the wafer housing 104. It will be appreciated that the stops 151 may prevent the electrical mating connectors 120, 132 and ground tabs 143 extending from each wafer assembly 106 from being damaged when the wafer assembly 106 is placed in the wafer housing 104.

The wafer housing 104 may be configured to mate with a header module, such as the header module described in U.S. patent application Ser. No. 12/474,568, filed May 29, 2009, the entirety of which is hereby incorporated by reference.

Figure 7:
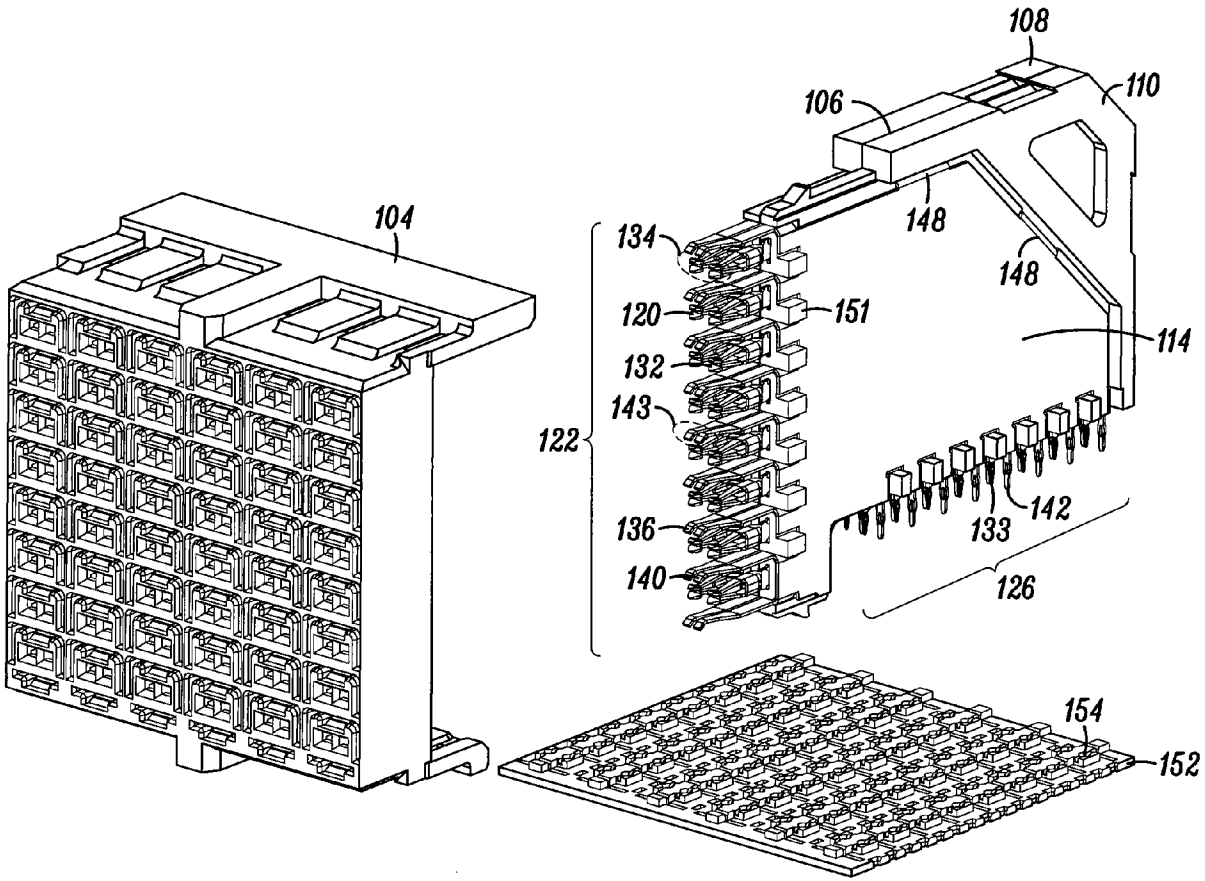
FIG. 7 is a partially exploded view of a portion of a high-speed backplane connector system.

As shown in FIGS. 3 and 7, an organizer 152, such as one of the organizers described in U.S. patent application Ser. No. 12/474,568, filed May 29, 2009, may be positioned at the mounting end 126 of the plurality of wafer assemblies 102 that serves to securely lock the plurality of wafer assemblies 102 together. The organizer 152 comprises a plurality of apertures 154 configured to allow the substrate engagement elements 124, 133 138, 142 extending from each wafer assembly 106 to pass through the organizer 152 and engage with a substrate such as a backplane circuit board or a daughtercard circuit board, as known in the art. In some implementations, the substrate engagement elements 124, 133, 138, 142 passing through the organizer 152 may form a noise-cancelling footprint, such as one of the noise cancelling footprints described in U.S. patent application Ser. No. 12/474,568, filed May 29, 2009.

While various high-speed backplane connector systems have been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector system comprising:

a plurality of wafer assemblies defining a mating end and a mounting end, each of the wafer assemblies comprising:

a first overmolded array of electrical contacts, each electrical contact of the first overmolded array of electrical contacts defining an electrical mating connector extending past an edge of an overmold of the first overmolded array of electrical contacts at the mating end of the wafer assembly;

a first ground shield configured to be assembled with the first overmolded array of electrical contacts; and a second overmolded array of electrical contacts configured to be assembled with the first overmolded array of electrical contacts, each electrical contact of the second overmolded array of electrical contacts defining an electrical mating connector extending past an edge of an overmold of the second overmolded array of electrical contacts at the mating end of the wafer assembly; and a wafer housing adapted to position the plurality of wafer assemblies adjacent to one another in the electrical connector system.

2. The electrical connector system of claim 1, wherein for each wafer assembly, each electrical contact of the first overmolded array of electrical contacts is positioned in the wafer assembly adjacent to an electrical contact of the second array of electrical contacts to form a plurality of electrical contact pairs.

3. The electrical connector system of claim 2, wherein each of the wafer assemblies further comprises:

a second ground shield configured to be assembled with the second overmolded array of electrical contacts;

wherein the first ground shield defines a plurality of ground tab portions extending past the edge of the overmold of the first overmolded array of electrical contacts when the first ground shield is assembled with the first overmolded array of electrical contacts;

wherein the second ground shield defines a plurality of ground tab portions extending past the edge of the overmold of the second overmolded array of electrical contacts when the second ground shield is assembled with the second overmolded array of electrical contacts; and wherein each ground tab portion of the plurality of ground tab portions of the first ground shield is positioned in the wafer assembly adjacent to a ground tab portion of the plurality of ground tab portions of the second ground shield to form a plurality of ground tabs.

4. The electrical connector system of claim 3, wherein for each wafer assembly, a ground tab of the plurality of ground tabs is positioned between two pairs of electrical mating connectors of the plurality of electrical contact pairs at the mating end of the wafer assembly.

5. The electrical connector system of claim 2, where each electrical contact of the second overmolded array of electrical contacts mirrors an adjacent electrical contact of the first overmolded array of electrical contacts.

6. The electrical connector system of claim 2, wherein a distance between an electrical contact of the first overmolded array of electrical contacts and an adjacent electrical contact of the second overmolded array of electrical contacts is substantially the same throughout a wafer assembly of the plurality of wafer assemblies.

7. The electrical connector system of claim 2, wherein each electrical contact pair is a differential pair.

8. The electrical connector system of claim 1, wherein the overmold of the first overmolded array of electrical contacts and the overmold of the second overmolded array of electrical contacts comprises plastic.

9. The electrical connector system of claim 1, wherein each electrical mating connector of the first and second overmolded arrays of electrical contacts is dual-beam shaped.

10. The electrical connector system of claim 1, wherein for each wafer assembly, the first overmolded array of electrical contacts defines a plurality of stops configured to abut the wafer housing when the wafer assembly is positioned in the wafer housing.

11. A wafer assembly comprising:

a first overmolded array of electrical contacts, each electrical contact of the first overmolded array of electrical contacts defining an electrical mating connector extending past an edge of an overmold of the first overmolded array of electrical contacts at the mating end of the wafer assembly;

a first ground shield configured to be assembled with the first overmolded array of electrical contacts;

a second overmolded array of electrical contacts configured to be assembled with the first overmolded array of electrical contacts, each electrical contact of the second overmolded array of electrical contacts defining an electrical mating connector extending past an edge of an overmold of the second overmolded array of electrical contacts at the mating end of the wafer assembly; and a second ground shield configured to be assembled with the second overmolded array of electrical contacts.

12. The wafer assembly of claim 11, wherein each electrical contact of the first overmolded array of electrical contacts is positioned in the wafer assembly adjacent to an electrical contact of the second array of electrical contacts to form a plurality of electrical contact pairs.

13. The wafer assembly of claim 12, wherein the first ground shield defines a plurality of ground tab portions extending past the edge of the overmold of the first overmolded array of electrical contacts when the first ground shield is assembled with the first overmolded array of electrical contacts;

wherein the second ground shield defines a plurality of ground tab portions extending past the edge of the overmold of the second overmolded array of electrical contacts when the second ground shield is assembled with the second overmolded array of electrical contacts; and wherein each ground tab portion of the plurality of ground tab portions of the first ground shield is positioned in the wafer assembly adjacent to a ground tab portion of the plurality of ground tab portions of the second ground shield to form a plurality of ground tabs.

14. The wafer assembly of claim 13, wherein a ground tab of the plurality of ground tabs is positioned between two pairs of electrical mating connectors of the plurality of electrical contact pairs at the mating end of the wafer assembly.

15. The wafer assembly of claim 12, where each electrical contact of the second overmolded array of electrical contacts mirrors an adjacent electrical contact of the first overmolded array of electrical contacts.

16. The wafer assembly of claim 12, wherein a distance between an electrical contact of the first overmolded array of electrical contacts and an adjacent electrical contact of the second overmolded array of electrical contacts is substantially the same throughout the wafer assembly.

17. The wafer assembly of claim 11, wherein the overmold of the first overmolded array of electrical contacts and the overmold of the second overmolded array of electrical contacts comprises plastic.

18. The wafer assembly of claim 11, wherein each electrical mating connector of the first and second overmolded arrays of electrical contacts is dual-beam shaped.

19. A wafer assembly comprising:

a first overmolded array of electrical contacts, each electrical contact of the first overmolded array of electrical contacts defining an electrical mating connector extending past an edge of an overmold of the first overmolded array of electrical contacts at the mating end of the wafer assembly; and a second overmolded array of electrical contacts configured to be assembled with the first overmolded array of electrical contacts, each electrical contact of the second overmolded array of electrical contacts defining an electrical mating connector extending past an edge of an overmold of the second overmolded array of electrical contacts at the mating end of the wafer assembly;

wherein each electrical contact of the first overmolded array of electrical contacts is positioned in the wafer assembly adjacent to an electrical contact of the second array of electrical contacts to form a plurality of electrical contact pairs.

20. The wafer assembly of claim 19, further comprising:

a first ground shield configured to be assembled with the first overmolded array of electrical contacts, the first ground shield defining a plurality of ground tab portions extending past the edge of the overmold of the first overmolded array of electrical contacts when the first ground shield is assembled with the first overmolded array of electrical contacts; and a second ground shield configured to be assembled with the second overmolded array of electrical contacts, the second ground shield defining a plurality of ground tab portions extending past the edge of the overmold of the second overmolded array of electrical contacts when the second ground shield is assembled with the second overmolded array of electrical contacts; and wherein each ground tab portion of the plurality of ground tab portions of the first ground shield is positioned in the wafer assembly adjacent to a ground tab portion of the plurality of ground tab portions of the second ground shield to form a plurality of ground tabs.

* * * * *